US010244902B1

(12) United States Patent
Wagner

(10) Patent No.: US 10,244,902 B1
(45) Date of Patent: Apr. 2, 2019

(54) BACK SCRUBBER FOR USE WITH A WASHCLOTH

(71) Applicant: Jeff A Wagner, Long Valley, NJ (US)

(72) Inventor: Jeff A Wagner, Long Valley, NJ (US)

( * ) Notice: Subject to any disclaimer, the term of this patent is extended or adjusted under 35 U.S.C. 154(b) by 123 days.

(21) Appl. No.: 15/488,452

(22) Filed: Apr. 15, 2017

Related U.S. Application Data

(60) Provisional application No. 62/323,730, filed on Apr. 17, 2016.

(51) Int. Cl.

| | |
|---|---|
| ***A47L 13/46*** | (2006.01) |
| ***A47K 7/02*** | (2006.01) |
| *A47K 7/06* | (2006.01) |
| *A47K 7/03* | (2006.01) |

(52) U.S. Cl.
CPC ..... *A47K 7/028* (2013.01); *A47K 7/022* (2013.01); *A45D 2200/1018* (2013.01); *A47K 7/02* (2013.01); *A47K 7/03* (2013.01); *A47K 7/06* (2013.01)

(58) Field of Classification Search
CPC ..... A47K 7/028; A47K 7/022; A47K 7/02; A47K 7/03; A47K 7/06; A45D 2200/1018; A47L 13/46; A47L 13/40
See application file for complete search history.

(56) References Cited

U.S. PATENT DOCUMENTS

| | | | | |
|---|---|---|---|---|
| 5,003,659 | A | 4/1991 | Paepke | |
| 5,205,012 | A | 4/1993 | Coley | |
| 5,740,578 | A * | 4/1998 | Moore | A47L 13/20 15/147.2 |
| 7,055,204 | B2 * | 6/2006 | Ajluni | A47L 1/06 15/121 |
| 8,869,341 | B2 | 10/2014 | Bayham | |
| 2015/0033481 | A1 | 2/2015 | Rowan | |

FOREIGN PATENT DOCUMENTS

| | | | | |
|---|---|---|---|---|
| DE | 2645188 | A1 * | 4/1978 | A47K 11/10 |

* cited by examiner

*Primary Examiner* — Shay Karls

(57) ABSTRACT

A back scrubber for use with a variety of different washcloths includes an elongate shaft, a frame attached to a distal end of the shaft and a set of flexible teeth extending from the frame toward the center of the frame. The frame defines an inner area over which the washcloth wraps to define a back scrubbing surface. The tips of the teeth form an opening through which an excess portion of the washcloth that wraps over the inner area and the frame enters to be in contact with an under side of the back scrubbing surface of the washcloth.

17 Claims, 4 Drawing Sheets

BACK SCRUBBER FOR USE WITH A WASHCLOTH

CROSS REFERENCE TO RELATED APPLICATIONS

This application claims the benefit of U.S. Provisional Application No. 62/323,730, filed Apr. 17, 2016, which is incorporated by reference herein.

TECHNICAL FIELD

The present invention relates to back scrubbers and more particularly a back scrubber having an interchangeable cleaning element which can clean with a rubbing or scrubbing action.

BACKGROUND OF THE INVENTION

In the prior art, there are several examples of a cleaning apparatus which consists of a shaft with an interchangeable cleaning element. U.S. Pat. No. 5,003,659 to Paepke (1991) discloses a molded plastic shaft with a substantially flat surface provided with a plurality of hook-like elements to removably capture a plurality of loops carried by a sponge-like cleaning means. U.S. Pat. No. 8,869,341 to Bayham (2014) discloses a shaft for temporarily securing a man-made loofah. The securing means is a plurality of crook-shaped bristles.

As opposed to sponges and loofahs, the preferred cleaning tool for many bathers is the washcloth. The washcloth when wrapped around the hand becomes a compliant cleaning pad and is well suited to washing the body. In addition users are attracted to aesthetic aspects of the washcloth and often choose washcloths to match their towels or decor. Washcloths also vary in size, and thickness and roughness of the fabric and users are attracted to these aspects as well. In addition washcloths are easily laundered with other goods. Neither of the aforementioned inventions is designed to use a washcloth. U.S. Pat. No. 5,205,012 to Coley (1993) discloses a rigid shafted tool for temporarily securing a washcloth. In a first embodiment, the washcloth is wrapped around the flat front face of the head of the tool and the excess material of the washcloth is forced into a recess in back face of the tool head. The recess is sized to retain the material. In a second embodiment the washcloth is secured with an elastic band. The difficulty with the first embodiment is that no single size of recess can accommodate the various amounts of excess material that will result when the tool is used with washcloths of various size and thickness. A disadvantage of the second embodiment is the requirement of a second item, the elastic band, for securing the washcloth. A further disadvantage of both embodiments relative to Paepke and Bayham is the use of a rigid face over which to wrap the washcloth.

The sponge of Paepke and the man-made loofah of Bayham, are compliant elements. A compliant element allows for greater contact with the body, better follows the contours and hollows of the body, and is more comfortable for the bather. In U.S. patent application 20150033481, Rowan discloses another means of securing a washcloth to a rigid shaft. The securing means is an aperture or hole near one end of an elongate arc-shaped shaft. The user is directed to pass the washcloth through the hole and either tie the ends of the washcloth together or tie the washcloth in a knot which prevents the washcloth from slipping through the hole. In either case there are serious disadvantages. First, many washcloths, particularly those of higher quality, are thick enough relative to their overall size that they cannot be tied in a knot. Second, a washcloth secured in this manner will not cover the entire head of the tool so that the user will often have the discomfort of rubbing against their body with a rigid tool. Finally, no single sized hole will grip a variety of washcloth thicknesses firmly. The user can anticipate attempting to rub their body with a loosely held knot in a thin washcloth along with intermittent contact with the rigid tool surface. Although a knot in a washcloth is more compliant than the rigid surface of Coley, the imperfect means of securing will interfere with use.

Therefore, there is a need to provide a back scrubber that extends the reach of a bather using a traditional washcloth which is compatible with washcloths of a variety of shapes and thicknesses. There is also a need to provide a method of securing a washcloth to a shaft which does not require any tools or additional fastening components. There is also a need for the secured washcloth to be formed into a compliant cleaning pad that fully covers the shaft near the end in contact with the bather. There is also a need to provide such a back scrubber that dries rapidly and completely after the washcloth is removed thereby discouraging the growth of mold, mildew, or other organisms. There is also a need to provide such a back scrubber that is economical to produce, durable in use, and essentially non-disposable and environmentally responsible. There is also a need to provide such a scrubber that can be sterilized when used in a hospital or hotel setting.

SUMMARY OF THE DISCLOSURE

According to one principle of the present invention, a back scrubber for use with a washcloth is provided. The back scrubber includes an elongate shaft, a frame attached to a distal end of the shaft and a set of flexible teeth extending from the frame toward the center of the frame. The frame defines an inner area over which the washcloth wraps to define a back scrubbing surface. The tips of the teeth form an opening through which an excess portion of the washcloth that wraps over the inner area and the frame enters to be in contact with an under side of the back scrubbing surface of the washcloth.

Advantageously, when the back scrubbing surface of the washcloth is pushed against the skin, the tips of the teeth move toward each other to grab the excess portion of the washcloth to more securely fix the washcloth in place.

DETAILED DESCRIPTION OF THE INVENTION

Figure 1A:
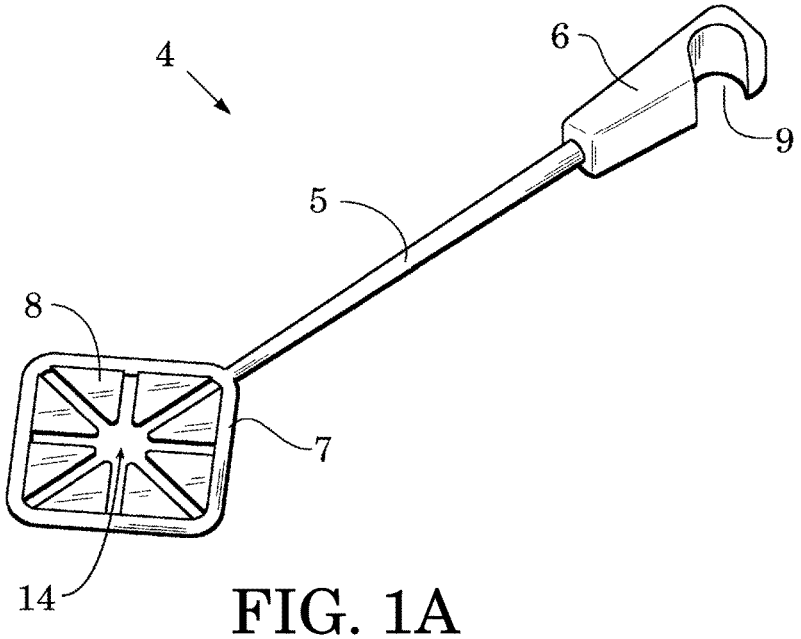
FIG. 1A is a perspective view of back scrubber according to one embodiment of the present invention.
Figure 2A:
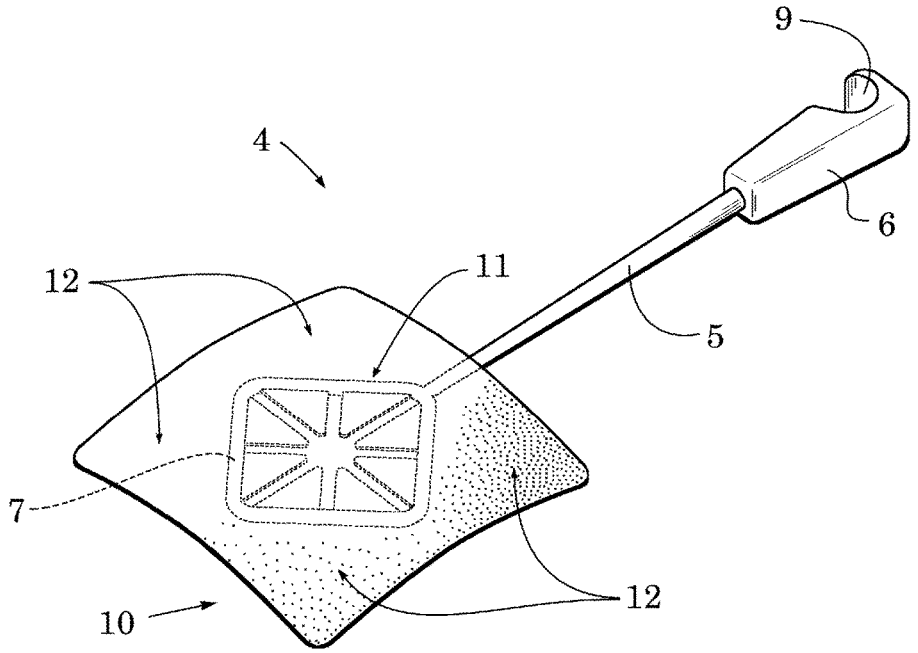
FIG. 2A shows the placement of a washcloth over the ring frame of the back scrubber in preparation for securing the washcloth.

With reference to FIGS. 1A and 2A, the current inventive back scrubber 4 includes an elongate shaft 5 with a grip 6 formed near a proximal end and a ring frame 7 formed at the opposite distal end. It is to be understood that the term "elongate shaft" can refer to elongate member of any cross section, not only the circular cross section shown in the preferred embodiment.

The frame 7 defines an inner area over which the washcloth 10 wraps and carries inward facing flexible teeth 8. FIG. 1A shows eight teeth 8. As shown, the width of each tooth 8 decreases toward the center of the inner area in the shape of a triangle.

Storage hook 9 is formed as a recess within the volume of grip 6 and is shaped and sized to allow the back scrubber 4 to hang from a shower head supply pipe or shower curtain rod. Accordingly, the hook 9 is positioned to face the same direction as the planar surface defined by the ring frame 7 such that the ring frame lies flat against the wall.

Figure 1B:
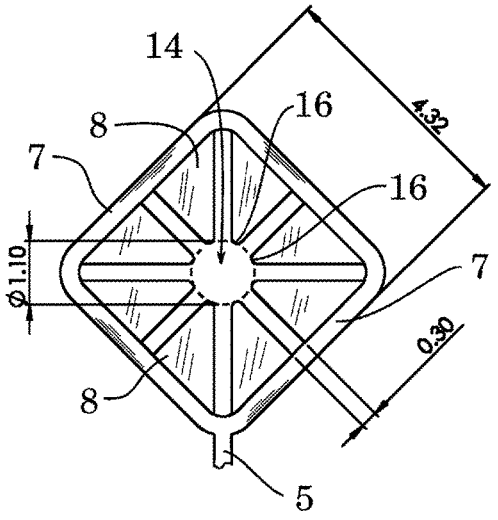
FIG. 1B is a plan view of a ring frame of the back scrubber of FIG. 1A.

FIG. 1B shows a plan view of the ring frame 7 and teeth 8. The ring frame 7 as shown is in the form of a diamond with four contiguous sides that form a closed ring. The length of each side is 4.32 inches. The opening formed by the tips 16 is 1.10 inches while the constant gap between two adjacent teeth 8 is 0.30 inches. Preferably, the diameter of the opening 14 is at least 0.5 inches and at most 2.5 inches in its preformed state before the washcloth has been secured over the ring frame 7. Preferably, the constant gap is between 0.1 inch and 1.0 inch, inclusive.

With reference to FIG. 2A, a washcloth 10 has a washcloth central region 11 placed against and across a first side of the opening in ring frame 7 and a washcloth outer region 12 initially extending beyond the periphery of ring frame 7. The washcloth central region 11 defines a back scrubbing surface which contacts the skin. The division of the washcloth 10 into a washcloth central region 11 and a washcloth outer region 12 is not an actual physical division and is only made to facilitate further description of the invention.

Figure 2B:
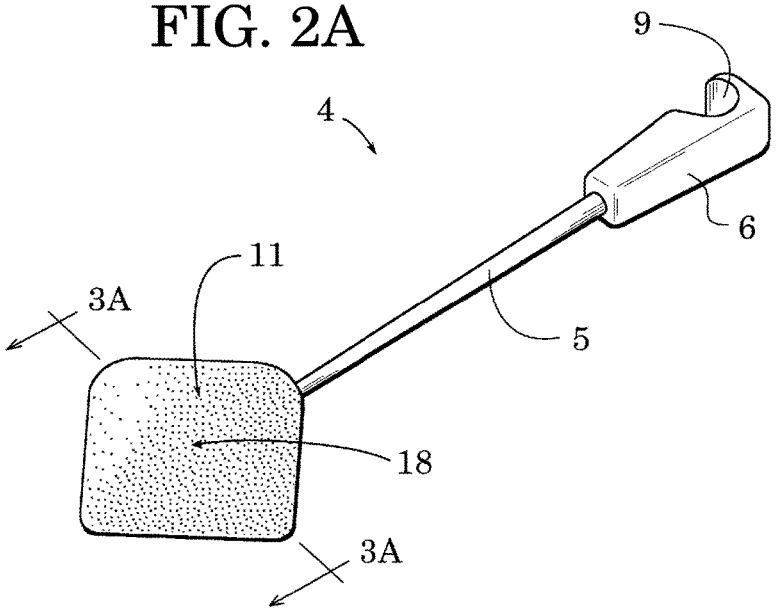
FIG. 2B is a perspective view showing the back scrubber with the washcloth secured.
Figure 3A:
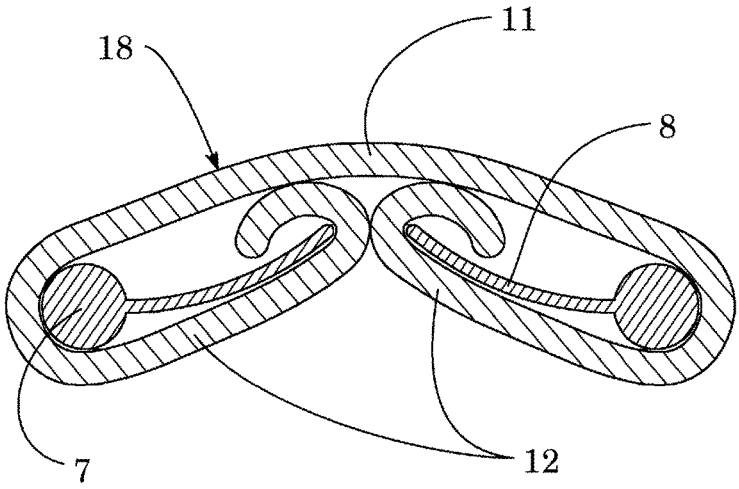
FIG. 3A shows a cross-section of the back scrubber along line 3A-3A in FIG. 2A.

With reference to FIGS. 1B, 2B and 3A, the material forming washcloth outer region 12 is wrapped around the periphery of ring frame 7. The flexible teeth 8 extend from the frame 7 toward the center of the inner area defined by the ring frame 7 with each tooth terminating at a tip 16 such that the tips of the teeth form an opening 14. The excess portion of the washcloth 10 that wraps over the inner area and the frame 7 enters through the opening 14 to be in contact with an under side of the back scrubbing surface 18 of the washcloth 10. Thus, in use, the excess portion of the washcloth 10 is in contact with both sides of the teeth as shown in FIG. 3A. The material forming washcloth outer region 12 deforms the material forming washcloth central region 11 outward to create a compliant and generally convex back scrubbing cleaning pad as shown in FIG. 3A. Inward facing flexible teeth 8 temporarily secure material forming washcloth outer region 12 in place through the opening 14 in ring frame 7.

Preferably, as shown in FIG. 3A, the teeth 8 are preformed to be in a concave shape. Advantageously, when the back scrubber 4 is in use, the scrubbing action causes the back scrubbing surface of the washcloth 10 to be pushed downward toward the center of the frame 7, which causes the tips 16 of the teeth 8 to be drawn closer together which, in turn, presses against the excess portion of the washcloth 10 to more securely fix the washcloth in place. For certain wash cloth material, the concave shape of the teeth 8 may make such action more effective.

Figure 3B:
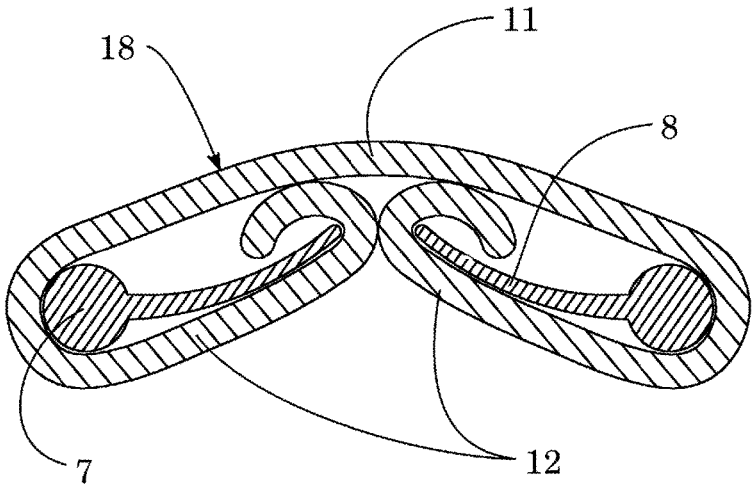
FIG. 3B shows a cross-section of the back scrubber along line 3A-3A in FIG. 2A, in which the thickness of the teeth tapers towards the center of the ring frame.

Preferably, the teeth are made of thermoplastic material such as polypropylene and polyethylene. In FIG. 3A, the thickness of the teeth 8 is uniform. Alternatively, as shown in FIG. 3B, the thickness of the teeth 8 gradually decreases or tapers toward the tip 16 to provide additional strength near the frame 7. The tapered teeth 8 in FIG. 3B may be useful for thicker washcloths.

In the preferred embodiment, the back scrubber 4 is formed as a single part molded from a plastic such as polyethylene or polypropylene which is relatively rigid in thicker sections such as the cross-sections of shaft 5 or ring frame 7, but which will allow for flexibility in the thinner section of inward facing flexible teeth 8. Single piece molded construction is economical and creates a form which is free of joints that may trap moisture or soap residue which promote the growth of mold and mildew. Other materials or combinations of materials are possible. For example the inventive back scrubber 4 could be formed from tubular aluminum with inward facing flexible teeth 8 formed from plastic and mechanically fastened.

Figure 4:
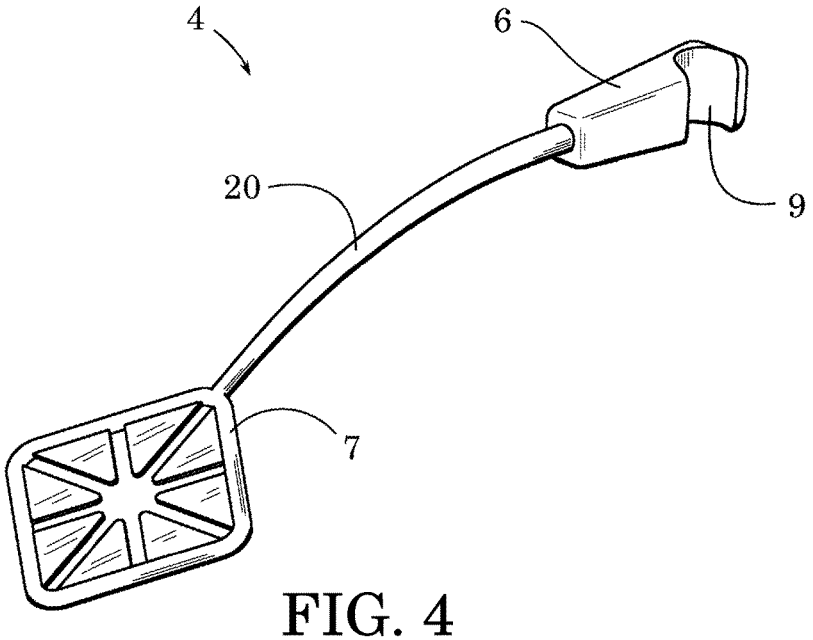
FIG. 4 is a perspective view of an alternate embodiment of a back scrubber in which the shaft is curved laterally away from a plane of the ring frame.

FIG. 4 is a perspective view of an alternate embodiment of a back scrubber in which a shaft 20 is curved laterally away from a plane defined by the ring frame 7.

Figure 5:
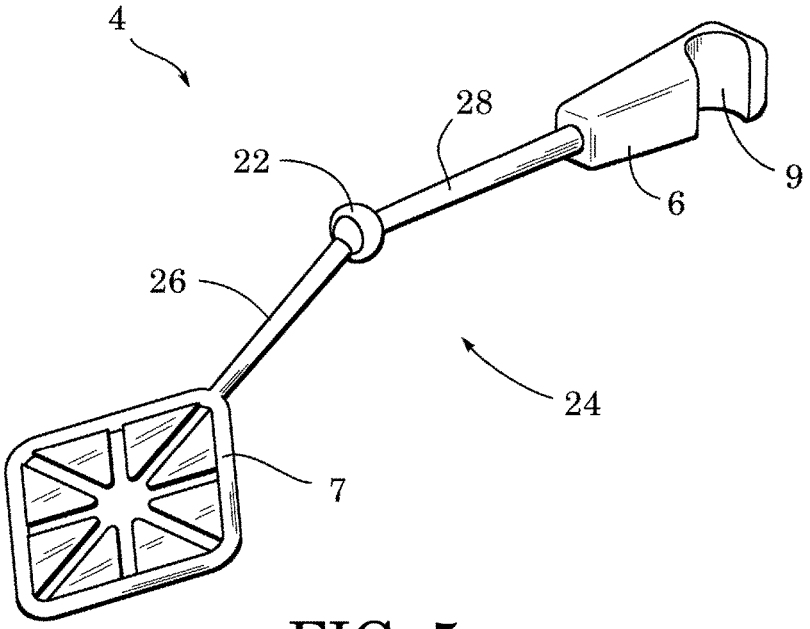
FIG. 5 is a perspective view of another alternative embodiment of a back scrubber in which the shaft includes an adjustable pivot.

FIG. 5 is a perspective view of another alternative embodiment of a back scrubber in which a shaft 24 includes an adjustable pivot 22 coupling proximal shaft 28 and distal shaft element 26.

To use the invention, the bather places a washcloth 10 with washcloth central region 11 against a first side of ring frame 7. The washcloth 10 may either be wet or dry, soaped or un-soaped. Using the fingers, the bather wraps the washcloth outer region 12 around the periphery of ring frame 7 and forces the gathered excess portion of washcloth outer region 12 through the opening in ring frame 7 from the second side (underside) of ring frame 7. The gathered material of washcloth outer region 12 will collect in the confined volume between inward facing flexible teeth 8 and washcloth central region 11 forcing the material of washcloth central region 11 away from the plane of ring frame 7 thereby forming a compliant and generally convex cleaning pad as shown in FIGS. 3A and 3B.

With the washcloth 10 thus secured to back scrubber 4 and formed into a compliant back scrubbing cleaning pad, the bather grasps and orients the back scrubber 4 by grip 6 and proceeds to clean hard to reach areas such as the back of the body with a rubbing or scrubbing action. The location of storage hook 9 within the volume grip 6 allows the bather to grasp the grip from any direction without interference from storage hook. Subsequent removal of the washcloth 10 from back scrubber 4 is accomplished by pushing or pulling the material forming washcloth outer region 12 from the opening in ring frame 7. After use the back scrubber 4 may be hung from a shower head supply pipe or shower curtain rod using storage hook 9.

Unlike the prior art, the back scrubber of the current invention allows a bather to secure washcloths that vary in size and thickness. The securing or removal of the washcloth is rapidly accomplished using only the hands and fingers and without any tools or additional fastening components. A further advantage over the prior art is that the material of the washcloth 10 is formed into a compliant cleaning pad which fully covers the shaft 5 near the distal end in contact with the bather. The use of a single piece molded construction creates a back scrubber that will not retain moisture or soap residue in crevices or joints between components. Such a back scrubber will dry rapidly after the washcloth is removed thereby discouraging the growth of mold and mildew and further may be easily cleaned or sterilized. Such a back scrubber will also be sturdy and economical to produce for example by injection molding.

With reference to the foregoing text and figures, one practiced in the relevant arts will see that the inventive back scrubber achieves the desired objects, overcomes the deficiencies of the prior art, and fulfills the needs of the many bathers who choose to use a traditional washcloth and who wish to clean hard to reach areas of the body. One practiced in the art will also appreciate that the embodiment shown could be modified in various ways without altering the basic function or advantages of the device. For example the ring frame, which has been shown with a generally diamond-like shape, could be in a round or elliptical shape, or even be interrupted by a gap in the ring without any significant loss of function. Accordingly, the scope of the invention is not limited to the foregoing specification, but instead is given by the appended claims along with their full range of equivalents.

What is claimed is:

1. A back scrubber for use with a washcloth comprising:
an elongate shaft having a proximal end and a distal end;
a frame attached to the distal end of the shaft and defining an inner area over which the washcloth wraps to define a back scrubbing surface;
a plurality of flexible teeth extending from the frame toward the center of the inner area with each tooth terminating at a tip such that the tips of the teeth form an opening through which an excess portion of the washcloth that wraps over the inner area and the frame enters to be in contact with an under side of the back scrubbing surface of the washcloth, wherein the opening defined by the tips of the teeth is sufficiently large to receive the excess portion so as to form a generally convex compliant back scrubbing surface of the washcloth, and wherein when the back scrubbing surface is pushed against the skin, the tips of the teeth move toward each other to grab the excess portion of the washcloth tighter to more securely fix the washcloth in place.

2. The back scrubber of claim 1, wherein the diameter of the opening is at least 0.5 inches.

3. The back scrubber of claim 1, wherein the frame includes four contiguous sides that form a closed ring.

4. The back scrubber of claim 1, wherein the thickness of each tooth tapers toward the center of the inner area.

5. The back scrubber of claim 1, wherein the width of each tooth decreases toward the center of the inner area.

6. The back scrubber of claim 1, wherein each tooth is preformed into a concave shape such that when the back scrubbing surface is pushed against the skin, the tips of the teeth move toward each other to grab the excess portion of the washcloth tighter.

7. The back scrubber of claim 1, wherein the frame and the plurality of teeth are a single integrally molded piece.

8. The back scrubber of claim 1, wherein the frame, plurality of teeth and shaft are a single integrally molded piece.

9. The back scrubber of claim 1, wherein the frame and the plurality of teeth are made of thermoplastic material.

10. The back scrubber of claim 1, wherein the shaft curves laterally away from a plane defined by the frame.

11. The back scrubber of claim 1, wherein the shaft includes a proximal shaft and a distal shaft pivotally coupled to the proximal shaft.

12. The back scrubber of claim 1, wherein the frame is substantially in the shape of a diamond.

13. A back scrubber for use with a washcloth comprising:
an elongate shaft having a proximal end and a distal end;
a closed ring frame attached to the distal end of the shaft and defining an inner enclosed area over which the washcloth wraps to define a back scrubbing surface;
a plurality of spaced apart flexible teeth and extending from the ring frame toward the center of the enclosed inner area with each tooth terminating at a tip such that the tips of the teeth form an opening through which an excess portion of the washcloth that wraps over the inner area and the frame enters to be in contact with an under side of the back scrubbing surface of the washcloth, wherein the opening defined by the tips of the teeth is sufficiently large to receive the excess portion so as to form a generally convex compliant back scrubbing surface of the washcloth, and wherein when the back scrubbing surface is pushed against the skin, the tips of the teeth move toward each other to grab the excess portion of the washcloth tighter to more securely fix the washcloth in place.

14. The back scrubber of claim 13, wherein the diameter of the opening is at least 0.5 inches and the frame includes four contiguous sides that form a closed ring.

15. The back scrubber of claim 13, wherein the thickness of each tooth tapers toward the center of the inner area, and the width of each tooth decreases toward the center of the inner area.

16. The back scrubber of claim 13, wherein each tooth is preformed into a concave shape such that when the back scrubbing surface is pushed against the skin, the tips of the teeth move toward each other to grab the excess portion of the washcloth tighter.

17. The back scrubber of claim 13, wherein the frame, plurality of teeth and shaft are a single integrally molded piece made of thermoplastic material.

* * * * *